US010231534B1

(12) United States Patent
Meador, III et al.

(10) Patent No.: US 10,231,534 B1
(45) Date of Patent: Mar. 19, 2019

(54) BACK SUPPORT FRAME ATTACHMENT SYSTEM FOR A BACKPACK

(71) Applicant: MMI Outdoor, Inc., Montgomery, AL (US)

(72) Inventors: William V. Meador, III, Opelika, AL (US); Ryan T. Torpey, Montgomery, AL (US); Jacob S. Pugh, Montgomery, AL (US)

(73) Assignee: MMI Outdoor, Inc., Montgomery, AL (US)

( * ) Notice: Subject to any disclaimer, the term of this patent is extended or adjusted under 35 U.S.C. 154(b) by 0 days.

(21) Appl. No.: 15/670,565

(22) Filed: Aug. 7, 2017

(51) Int. Cl.
*A45F 3/08* (2006.01)
*A45F 3/10* (2006.01)
*A45F 3/04* (2006.01)

(52) U.S. Cl.
CPC ..... *A45F 3/08* (2013.01); *A45F 3/10* (2013.01); *A45F 2003/045* (2013.01)

(58) Field of Classification Search
CPC ..... A45F 3/08; A45F 3/10; A45F 2003/045
USPC ..... 224/628, 630, 631
See application file for complete search history.

(56) References Cited

U.S. PATENT DOCUMENTS 4,830,245 A * 5/1989 Arakaki ..... A45F 3/04 2/2.5
5,131,576 A * 7/1992 Turnipseed ..... A45F 3/08 224/262
5,320,262 A * 6/1994 Levis ..... A45F 3/04 224/261
5,366,126 A * 11/1994 Dausien ..... A45F 3/04 224/630
5,904,282 A * 5/1999 Gleason ..... A45F 3/08 224/263
5,954,253 A * 9/1999 Swetish ..... A45F 3/08 224/628
D468,792 S * 1/2003 Jacoway ..... D21/801
6,892,915 B2 * 5/2005 Mares ..... A45F 3/04 224/148.5
D507,697 S * 7/2005 Seong ..... D3/216
7,028,873 B1 * 4/2006 Collier ..... A45F 3/08 224/628
7,644,847 B2 * 1/2010 Howell ..... A45F 3/08 224/628
7,694,862 B2 * 4/2010 Bergeron ..... A45F 5/02 224/665

(Continued)

*Primary Examiner* — Nathan J Newhouse
*Assistant Examiner* — Lester L Vanterpool
(74) *Attorney, Agent, or Firm* — Bush Intellectual Property Law; Kenneth M. Bush

(57) ABSTRACT

A back support frame attachment system for a container, such as a backpack. A back support frame has a slot at its bottom end. A back portion of a container has a sleeve at its top end and a strap at its bottom end. The top end of the back support frame is insertable into the sleeve at the top end of the back portion and the strap is positionable through the slot in the bottom end of the back support frame. A first portion of the strap has hook material and a second portion of the strap has loop material, or vice versa. A folded middle portion of the strap is insertable through the slot at the bottom end of the back support frame such that the hook material can be attached to the loop material. The strap is operable to disconnect the bottom end of the back support frame from the bottom end of the back portion when a free end of the strap is pulled.

6 Claims, 3 Drawing Sheets

(56) References Cited

U.S. PATENT DOCUMENTS

| | | | | |
|---|---|---|---|---|
| 7,793,809 | B2 * | 9/2010 | Howell | A45F 3/10 224/261 |
| D630,011 | S | 1/2011 | Knight et al. | |
| 7,963,427 | B2 * | 6/2011 | Calkin | A41D 13/0012 224/675 |
| 8,678,258 | B1 * | 3/2014 | Knight | A45F 3/08 224/628 |
| 2005/0035170 | A1 * | 2/2005 | Sears | A45F 3/04 224/630 |
| 2008/0142562 | A1 * | 6/2008 | Cheng | A45F 3/08 224/628 |
| 2013/0105537 | A1 * | 5/2013 | Shalom | A45F 3/04 224/628 |
| 2015/0189974 | A1 * | 7/2015 | Bercaw | A45F 3/04 224/633 |

* cited by examiner

BACK SUPPORT FRAME ATTACHMENT SYSTEM FOR A BACKPACK

FIELD OF THE INVENTION

This invention relates to back support frames for a backpack and, more particularly, to an external backpack back support frame system, wherein the back support frame is shaped to the contour of the spine and back of a user, having shoulder straps, padding, and a belt attached reversibly thereto, and which can be released quickly and easily from the back of a backpack.

BACKGROUND OF THE INVENTION

Internal frame packs are generally characterized by having several various sized pocket compartments into which a metal support frame is placed. Typically, tubular sleeves are sewn onto the inside of the largest, lower compartment of the pack into which metal strips or stays are slidably, placed. The stays are commonly made of high grade aluminum which is bent to the vertical contours of the wearers back. Usually the stays are attached onto a sheet of plastic which provides a rigid surface. On the outside of this rigid surface the shoulder straps and waist belt are attached, so that the weight of the load in the pack is transferred to the waist belt of the user, and not the shoulders. An important benefit of an internal frame pack is that it fits closely to the body of the user. This close fit provides a low center of gravity, and the separate strips or stays of the internal frame allow the pack to move with the user (torsional flex).

U.S. Pat. No. 8,678,258 discloses a vertically and horizontally flexible backpack back support frame having a Y-shaped configuration to conform to the shape of a back of a user. The back support frame is attached to the back of a backpack by inserting it into a pocket on the back of backpack. Backpack straps, belts, and padding attach reversibly and pivotably to the back support frame when the back support frame is in the pocket. However, to remove the back support frame from the pocket the straps and belts need to be removed first.

What is needed is an attachment system for the back support frame which does not require the use of a pocket and which allows the support frame to be removed from the backpack without the need to remove belts, straps, and padding from the support frame.

SUMMARY OF THE INVENTION

This invention is a back support frame attachment system for a container, such as, for example, a backpack. A back support frame has a head end and a bottom end with the bottom end of the back support frame having a slot. The container has a back portion with a top end and a bottom end. The top end of the back portion has a sleeve and the bottom end of the container has a strap, wherein the top end of the back support frame is inserted into the sleeve at the top end of the back portion and the strap is positioned through the slot in the bottom end of the back support frame. A first portion of the strap has hook material and a second portion of the strap has loop material, or vice versa, wherein the bottom end of the back support frame is connected to the bottom end of the back portion by the hook material and the loop material. A folded middle portion of the strap is inserted through the slot at the bottom end of the back support frame and the hook material is attached to the loop material. The strap is constructed to disconnect the bottom end of the back support frame from the bottom end of the back portion when a free end of the strap is pulled.

A method of attaching the back support frame to a back portion of a container includes inserting a top end of the back support frame into a sleeve at the top end of said back portion and inserting the strap at the bottom end of the back portion through the slot at the bottom end of the back support frame. Hook material on the first portion of the strap is connected to loop material on the second portion of the strap. This is done, preferably, by inserting a folded middle portion of the strap through the slot at the bottom end of the back support frame and attaching the hook material to the loop material. The bottom end of the back support frame is disconnected from the bottom end of the back portion by pulling a free end of the strap.

An advantage of the present invention is a back support frame attachment system that provides rapid and easy external attachment of a back support frame to the back portion of a backpack.

Another advantage is a back support frame attachment system that allows attachment of a belt, padding, and straps which do not need to be removed to detach the back support frame from the back pack.

These and other features of the invention will become apparent from the following detailed description of the invention.

DETAILED DESCRIPTION OF THE INVENTION

While the following description details the preferred embodiments of the present invention, it is to be understood that the invention is not limited in its application to the details of construction and arrangement of the parts illustrated in the accompanying figures, since the invention is capable of other embodiments and of being practiced in various ways.

Figure 1:
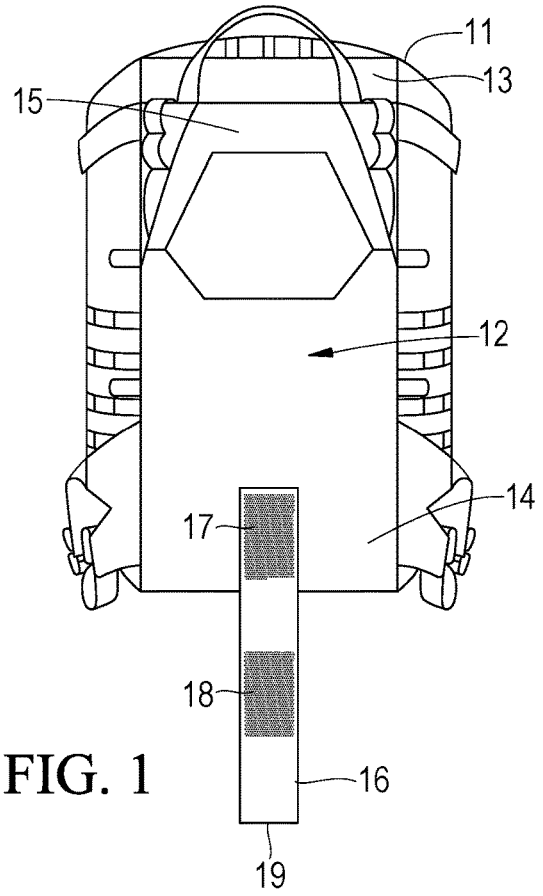
FIG. 1 shows a rear view of a backpack having a sleeve at a top end and a strap at a bottom end of a back portion of the backpack.

FIG. 1 shows a rear view of a backpack 11 having a sleeve 15 at a top end 13 and a strap 16 at a bottom end 14 of a back portion 12 of the backpack 11. A portion 17 of the strap 16 is shown having hook material and a portion 18 of the strap 16 is shown as having loop material. However, portion 17 could have the loop material and portion 18 could have the hook material. The hook and loop materials form a fastener by methods well known in the art. The strap 16 has a free end 19.

Figure 2:
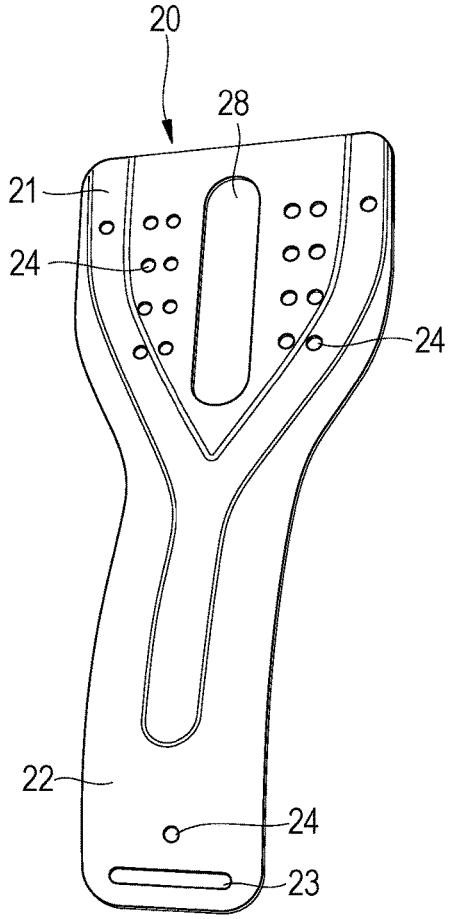
FIG. 2 shows a perspective view of a back support frame.

FIG. 2 shows a perspective view of a back support frame 20 which is shaped to conform to the shape of a user's back when in use. The back support frame 20 has a top end 21 and a bottom end 22 and a slot 23 at the bottom end 22. The back support frame 20 has a plurality of holes 24 for attaching fasteners which will fasten belts, straps, and padding to the back support frame 20. The back support frame 20 also has a longitudinal opening 28 for fastening with straps.

Figure 3:
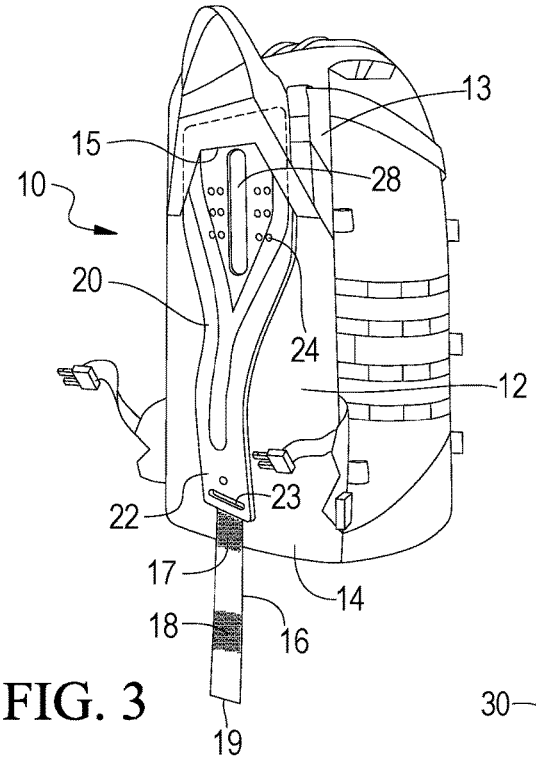
FIG. 3 shows a perspective view of the back support frame attachment system of the present invention with a top end of the back support frame inserted into a sleeve at the top end of the back portion.
Figure 4:
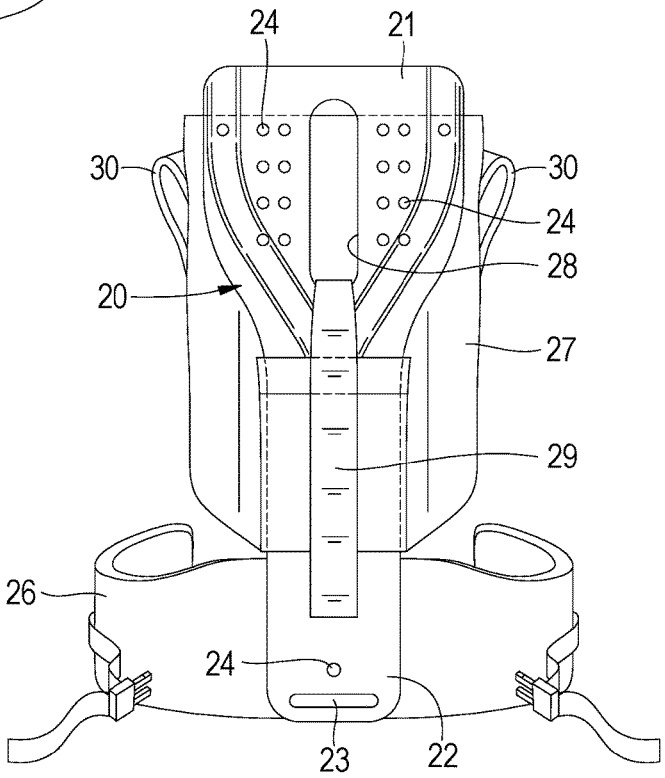
FIG. 4 shows a rear view of the back support frame with a belt, padding, and straps attached thereto.

FIG. 3 shows a perspective view of the back support frame attachment system 10 of the present invention with the top end 21 of the back support frame 20 inserted into the sleeve 15 at the top end 13 of the back portion 12. In this configuration, the backpack 11 is suspended on the back support frame 20. FIG. 4 shows a rear view of the back support frame 20 with a belt 26, padding 27, securing strap 29, and shoulder straps 30 attached thereto.

Figure 5:
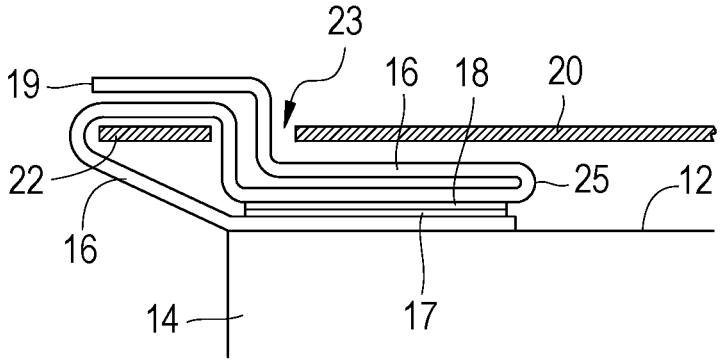
FIG. 5 shows a sectional illustration of the strap attached at the bottom end of the back portion as folded, with the folded portion inserted through the slot at the bottom end of the back support frame so that a free portion of the strap connects with a portion of the strap that is attached to the bottom end of the back portion of the backpack. A free end of the strap is shown remaining outside of the slot.

FIG. 5 shows a sectional illustration of the strap 16 attached at the bottom end 14 of the back portion 12. The strap 16 is folded, with the folded portion 25 inserted through the slot 23 of the back support frame 20 so that a free portion of the strap 16 connects with a portion of the strap 16 that is attached to the bottom end 14 of the back portion 12. A free end 19 of the strap 16 is shown remaining outside of the slot 23. The loop material on portion 18 of the strap 16 contacts the hook material on portion 17 which, thus, attaches portion 17 to portion 18. In this configuration, the bottom end 22 of the back support frame 20 is firmly attached to the bottom end 14 of the back portion 12. When the top end 21 of the back support frame 20 is positioned within the sleeve 15 of the back portion 12 and when the strap 16 is inserted through the slot 23 so that the hook and loop materials are fastened, the back pack 11 is firmly secured to the back support frame 20.

Figure 6:
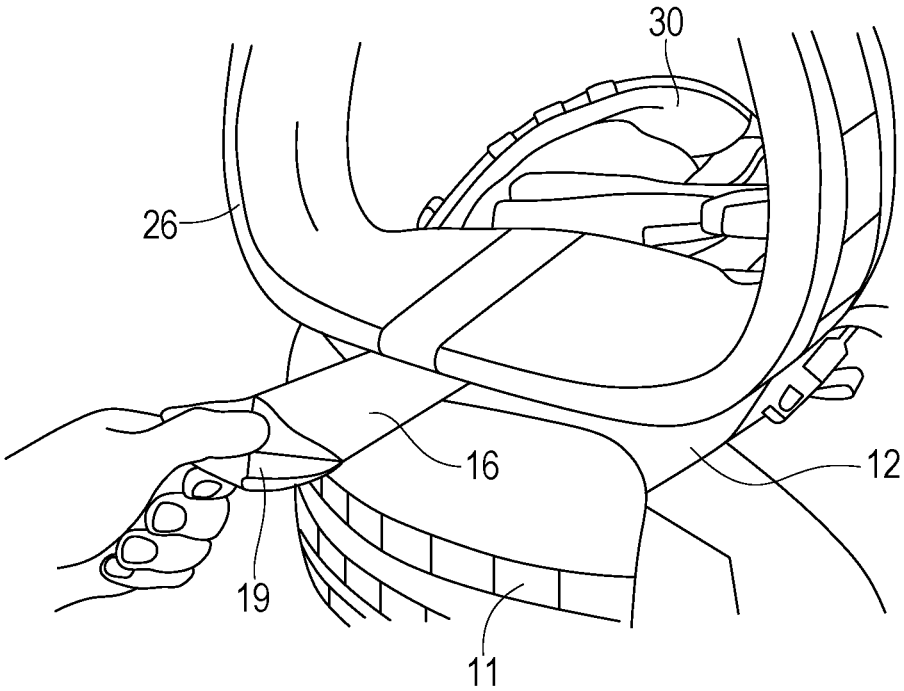
FIG. 6 shows a rear, bottom view of the back pack, illustrating pulling of the free end of the strap which will disconnect the bottom end of the back support frame from the bottom end of the back portion.

FIG. 6 shows a rear, bottom view of the back pack 11, illustrating that pulling of the free end 19 of the strap 16 will disconnect the bottom end 22 of the back support frame 20 from the bottom end 14 of the back portion 12. The top end 21 of the back support frame 20 can then be easily removed from the sleeve 15 at the top end 13 of the back portion 12. The belt 26, padding 27, securing strap 29, and shoulder straps 30 remain attached to the back support frame 20.

In use, a top end 21 of the back support frame 20 is inserted into the sleeve 15 at the top end 13 of the back portion 12 of backpack 11. The strap 16 at the bottom end 14 of the back portion 12 is inserted through the slot 23 at the bottom end 22 of the back support frame 20. Hook material (e.g. portion 17) on strap 16 is attached to loop material (e.g. portion 18) on strap 16. Preferably, the strap 16 is folded in a middle area and the folded portion 25 is inserted through the slot 23. The hook material on strap 16 is then pressed to the loop material on strap 16. The back portion 12 of the backpack 11 is then fully secured to the back support frame 20. The back support frame 20 can be easily released from the back portion 12 by pulling on the free end 19 of strap 16 to detach the hook material from the loop material and thereby allow removal of the strap 16 from the slot 23.

The foregoing description has been limited to specific embodiments of this invention. It will be apparent, however, that variations and modifications may be made by those skilled in the art to the disclosed embodiments of the invention, with the attainment of some or all of its advantages and without departing from the spirit and scope of the present invention. For example, back support frame attachment system of this invention can be constructed for use with any type of container for carrying a load on a person's back. A first portion of the strap 16 can have hook material and a second portion of the strap 16 can have loop material, or vice versa. Other connecting mechanisms can be used instead of hook and loop fastener. The back support frame can have any desired shape. Any type of material can be used for the strap 16 at the bottom end of the back portion.

It will be understood that various changes in the details, materials, and arrangements of the parts which have been described and illustrated above in order to explain the nature of this invention may be made by those skilled in the art without departing from the principle and scope of the invention as described herein and as recited in the following claims.

The invention claimed is:

1. A backpack assembly, comprising:

a) a back support frame having a frame top end, a frame bottom end, a frame first side, and a frame second side, said frame bottom end having a slot therethrough;

b) a container having a container side for engaging said frame second side of said back support frame, said container side having a container side top end and a container side bottom end;

c) a sleeve formed on said container side top end for reversibly receiving said frame top end therein;

d) a flexible strap having a strap first end affixed to said container side bottom end and a strap second end having a free distal end;

e) a first fastening material affixed to said strap first end; and f) a second fastening material affixed to said strap between said strap first end and said strap second end, wherein said first fastening material and said second fastening material are operable to releasably attach to each other;

g) wherein said strap is operable to be folded on itself to form a folded portion, wherein said folded portion is operable to be inserted through said slot from said frame first side to said frame second side such that said free distal end extends from said slot on said frame first side, wherein said second fastening material is operable to attach to said first fastening material to reversibly secure said frame bottom end to said container side bottom end when said folded portion is inserted through said slot and positioned on said frame second side, wherein said back support frame is reversibly secured to said container side when said frame top end is inserted into said sleeve and said frame bottom end is secured to said container side bottom end;

h) wherein said folded portion is operable to retract from said slot and said second fastening material is operable to detach from said first fastening material when said free distal end is pulled, wherein said frame bottom end is released from said container side bottom end when said second fastening material is detached from said first fastening material, wherein said back support frame is detached from said container side when said frame bottom end is released from said container side bottom end and said frame top end is removed from said sleeve.

2. A backpack assembly according to claim 1, wherein said first fastening material and said second fastening material comprise hook and loop fastening materials.

3. A method of assembling a backpack assembly, comprising the steps of:

a) providing a back support frame having a frame top end, a frame bottom end, a frame first side, and a frame second side, said frame bottom end having a slot therethrough;

b) providing a container having a container side for engaging said frame second side of said back support frame, said container side having a container side top end and a container side bottom end;

c) providing a sleeve formed on said container side top end;

d) providing a flexible strap having a strap first end affixed to said container side bottom end and a strap second end having a free distal end;

e) providing a first fastening material affixed to said strap first end;

f) providing a second fastening material affixed to said strap between said strap first end and said strap second end, wherein said first fastening material and said second fastening material are operable to releasably attach to each other;

g) inserting said frame top end into said sleeve;

h) folding said strap on itself to form a folded portion and inserting said folded portion through said slot from said frame first side to said frame second side such that said free distal end extends from said slot on said frame first side; and i) attaching said second fastening material to said first fastening material to reversibly secure said frame bottom end to said container side bottom end and thereby reversibly secure said back support frame to said container side.

4. A method according to claim 3, wherein said first fastening material and said second fastening material comprise hook and loop fastening materials.

5. A method of assembling and disassembling a backpack assembly, comprising the steps of:

a) providing a back support frame having a frame top end, a frame bottom end, a frame first side, and a frame second side, said frame bottom end having a slot therethrough;

b) providing a container having a container side for engaging said frame second side of said back support frame, said container side having a container side top end and a container side bottom end;

c) providing a sleeve formed on said container side top end;

d) providing a flexible strap having a strap first end affixed to said container side bottom end and a strap second end having a free distal end;

e) providing a first fastening material affixed to said strap first end;

f) providing a second fastening material affixed to said strap between said strap first end and said strap second end, wherein said first fastening material and said second fastening material are operable to releasably attach to each other;

g) inserting said frame top end into said sleeve;

h) folding said strap on itself to form a folded portion and inserting said folded portion through said slot from said frame first side to said frame second side such that said free distal end extends from said slot on said frame first side;

i) attaching said second fastening material to said first fastening material to reversibly secure said frame bottom end to said container side bottom end and thereby reversibly secure said back support frame to said container side;

j) pulling on said free distal end of said strap to retract said folded portion from said slot and detach said second fastening material from said first fastening material and thereby release said frame bottom end from said container side bottom end; and k) removing said frame top end from said sleeve.

6. A method according to claim 5, wherein said first fastening material and said second fastening material comprise hook and loop fastening materials.

* * * * *